US005312721A

United States Patent [19]

Gesing

[11] Patent Number: 5,312,721

[45] Date of Patent: May 17, 1994

[54] BLEACHABLE ANTIHALATION SYSTEM

[75] Inventor: Ingrid Gesing, Dreieich, Fed. Rep. of Germany

[73] Assignee: E. I. Du Pont de Nemours and Company, Wilmington, Del.

[21] Appl. No.: 995,100

[22] Filed: Dec. 18, 1992

[30] Foreign Application Priority Data

Dec. 24, 1991 [DE] Fed. Rep. of Germany ..... 4142956

[51] Int. Cl.[5] ..... G03C 5/38

[52] U.S. Cl. ..... 430/449; 430/510; 430/517; 430/522; 430/521; 430/520; 430/339; 430/964; 430/353; 430/617; 430/955; 252/583

[58] Field of Search ..... 430/510, 517, 522, 521, 430/520, 339, 964, 353, 617, 955, 449; 252/583

[56] References Cited

U.S. PATENT DOCUMENTS

| | | | |
|---|---|---|---|
| 3,502,476 | 3/1970 | Itano et al. | 430/339 |
| 3,745,009 | 7/1973 | Jenkins et al. | 430/522 |
| 3,876,431 | 4/1975 | Asakawa | 96/90 |
| 3,961,009 | 6/1976 | Yoda et al. | 528/481 |
| 4,033,948 | 7/1977 | Brown | 430/617 |
| 4,081,278 | 3/1978 | Dedinas et al. | 430/350 |
| 4,153,463 | 5/1979 | Lea | 430/522 |
| 4,196,002 | 4/1980 | Levinson et al. | 430/617 |
| 4,201,590 | 5/1980 | Levinson et al. | 430/617 |
| 4,336,323 | 6/1982 | Winslow | 430/339 |
| 4,376,162 | 3/1983 | Kawata et al. | 430/510 |
| 4,477,562 | 10/1984 | Zeller-Pendrey | 430/513 |
| 4,548,896 | 10/1985 | Sabongi et al. | 430/332 |
| 4,581,323 | 4/1986 | Fisher et al. | 430/513 |
| 4,594,312 | 6/1986 | Sabongi et al. | 430/339 |
| 4,897,405 | 1/1990 | Alessi et al. | 548/122 |
| 4,910,019 | 3/1990 | McCaleb | 548/122 |

OTHER PUBLICATIONS

Patent Abstracts of Japan, vol. 6, No. 192 (P-145)(1070) 30, Spe. 1982 & JP-A-57 101835, (Fuji Shashin Film K.K.), 24. Jun. 1983 *Zusammenfassung*.

Research Disclosure (1978) 17029.

Research Disclosure (1989) 29963.

*Primary Examiner*—Charles L. Bowers, Jr.

*Assistant Examiner*—Thomas R. Neville

[57] ABSTRACT

The invention involves a bleachable antihalation system, particularly for use in thermally developable photographic recording materials. This antihalation system contains, besides an antihalation dye, a bleaching agent that forms sulfurous acid or sulfurous acid derivatives on treatment with heat or irradiation with actinic radiation.

11 Claims, No Drawings

BLEACHABLE ANTIHALATION SYSTEM

FIELD OF THE INVENTION

The subject of this invention is a bleachable antihalation system, particularly for use in thermally developable photographic recording materials, containing at least one antihalation dye and a bleaching agent for the antihalation dye. The bleaching agent consists of one or more compounds that form sulfurous acid and/or sulfurous acid derivatives when heated or irradiated with actinic radiation.

BACKGROUND OF THE INVENTION

As is known, photographic recording materials contain so-called screening dyes or antihalation dyes to improve resolution. These dyes can be in the emulsion layer, but are preferably in light-insensitive auxiliary layers located between the support and the emulsion layer or on the back side of the support. In multilayer materials, these auxiliary layers can also be between the various emulsion layers. Without these antihalation layers, radiation reaching the photographic emulsion layer would be reflected in this layer, and image sharpness would decrease.

Because such antihalation layers impair the ultimate image by absorbing visible light, it is necessary to bleach the dyes or remove them completely after imagewise exposure. This is not a problem with aqueous-developable photographic recording materials, because antihalation dyes can be easily decolorized and/or dissolved and removed by treatment baths during or after aqueous development of the photographic recording material. However, this process cannot be used with thermally developable photographic recording materials, because the process steps with treatment solutions and the subsequently required drying should indeed be avoided in this dry development process.

Antihalation systems have been proposed in the past for thermally developable photographic recording materials that do not require added treatment solutions to bleach the antihalation dyes. Thus, U.S. Pat. No. 4,477,562 proposes fully strippable antihalation layers, which, however, can impair the storage stability of the photographic recording materials if these layers detach prematurely. The addition of various thermally active bleaching agents, such as hexaaryl bisimidazoles (U.S. Pat. Nos. 4,201,590 and 4,196,002), benzopinacols (U.S. Pat. No. 4,081,278), halogen compounds (U.S. Pat. No. 4,376,162), sydnones or iodonium salts (U.S. Pat. No. 4,581,323), and oxidizing agents (U.S. Pat. No. 4,336,323) is known. However, these can be used generally only for a limited selection of dyes or cannot achieve stable dye decolorization, so that, after a short time, background fog forms, degrading the recorded images. Special dyes that can be bleached by actinic radiation are also generally used, but these often require high temperatures or supplementary bleaching agents (U.S. Pat. Nos. 3,745,009, 4,594,312, 4,153,463, and 4,033,948).

Hence, interest continues to exist in antihalation systems for thermally developable recording materials that can be bleached without great technical expense after imagewise exposure.

SUMMARY OF INVENTION

Therefore, the problem involved in this invention is to make available bleachable antihalation systems for thermally developable photographic recording materials that can be bleached during or by a simple process step after thermal development and in which a large number of conventional antihalation dyes can be used.

This problem is solved by a bleachable antihalation system containing at least one antihalation dye and at least one bleaching agent; upon treatment with heat, actinic radiation or combination thereof said bleaching agent forms sulfurous acid, derivitized sulfuric acid, sulfur dioxide or combination thereof.

A more preferred bleachable antihalation system is bleachable antihalation system as recited above wherein said bleaching agent forms sulfur dioxide upon treatment with heat, actinic radiation or combination thereof, said bleaching agent further comprises water, hydroxide ions or combination thereof or is capable of forming water, hydroxide ions or combination thereof upon treatment with heat, actinic radiation or combination thereof.

DETAILED DESCRIPTION OF INVENTION

The invention's bleachable antihalation system containing one or more compounds that form sulfurous acid and/or sulfurous acid derivatives is used preferably in a process for preparing photographic recordings. In this process, a thermally developable photographic recording material comprising a support, at least one thermally developable photographic emulsion layer, a cover layer, and a bleachable antihalation system containing at least one antihalation dye and a bleaching agent is irradiated imagewise with actinic radiation and then treated thermally to form an image in the irradiated areas of the emulsion layer or emulsion layers. The energy required for formation of sulfurous acid and/or sulfurous acid derivatives from compounds essential to the invention can be supplied purely thermally or also photochemically. If the bleaching agents essential to the invention form sulfurous acid and/or sulfurous acid derivatives by irradiation with actinic radiation, an irradiation step to activate the bleaching agent is performed after the heat treatment. The type of actinic radiation depends on the bleaching agent.

Particularly advantageous are antihalation systems with a bleaching agent consisting of one or more compounds that form sulfurous acid and/or sulfurous acid derivatives when heat-treated. Such bleaching agents enable performing thermal development of the photographic recording material and decolorizing the antihalation dye directly in one process step. Specifically, advantageous bleaching agents are those effective at 85° to 150° C., preferably 90° to 125° C., and most preferably between 100° to 110° C.

The invention's bleaching agents consist of one or more compounds that form sulfurous acid and/or sulfurous acid derivatives preferably when heat-treated or irradiated with actinic radiation. Preferred bleaching agents of the invention contain at least one compound that forms sulfur dioxide when heat-treated. Particularly in this preferred case, the bleaching agent also contains or forms water and/or hydroxide ions. Such bleaching agents with compounds that split off sulfur dioxide in the presence of an aqueous or water-forming medium enable rapid bleaching of the antihalation dye.

Suitable compounds in accordance with the invention for forming sulfurous acid or sulfurous acid derivatives, either by direct cleavage or cleavage of an intermediate product that reacts with water molecules formed or present in the bleaching agent and/or hydroxide ions are, for example, sulfones, sulfurous acid derivatives, such as diesters, half esters, anhydrides, amide esters, and amide salts, or cyclic sulfurous acid hydrazides. These compounds can be either saturated or unsaturated, open-chain, alicyclic or heterocyclic, and aromatic or heteroaromatic. Heterocyclic and heteroaromatic compounds are preferred. Particularly useful in the invention's bleaching agents are sulfones, preferably 3-sulfolenes (2,5-dihydrothio-thiophene-1,1-dioxides), 1,2,3,5-oxathiadiazole-2-oxides, and thiadiaziridine-1,1-dioxes. Primarily 1,2,3,5-oxathiadiazole-2-oxides diaryl substituted in the 3 and 4 positions are particularly advantageous. The aryl groups of these compounds are substituted independently of each other or can bear one or more substituents comprising alkyl, aryl, ether ester, halogen, hydroxy, cyano, amino, carbonyl, carboxyl, carbamoyl, and sulfonyl groups, and carboxylic and heterocyclic annular rings.

Examples of particularly suitable compounds are:

1) 3,4-diphenyl-1,2,3,5-oxathiadiazole-2-oxide
2) 3-phenyl-4-(2-chlorophenyl)-1,2,3,5-oxathiadiazole-2-oxide
3) 3-phenyl-4-(4-chlorophenyl)-1,2,3,5-oxathiadiazole-2-oxide
4) 3-phenyl-4-(4-fluorophenyl)-1,2,3,5-oxathiadiazole-2-oxide
5) 3-phenyl-4-(2,6-dichlorophenyl)-1,2,3,5-oxathiadiazole-2-oxide
6) 3-phenyl-4-(2,4-dichlorophenyl)-1,2,3,5-oxathiadiazole-2-oxide
7) 3-phenyl-4-(4-bromophenyl)-1,2,3,5-oxathiadiazole-2-oxide
8) 3-(3-chlorophenyl)-4-(2-chlorophenyl)-1,2,3,5-oxathiadiazole-2-oxide
9) 3-(2,4-dichlorophenyl)-4-(4-fluorophenyl]-1,2,3,5-oxathiadiazole-2-oxide
10) 3-(3-chlorophenyl)-4-(4-trifluoromethylphenyl)-1,2,3,5-oxathiadiazole-2-oxide
11) 3-(3-chlorophenyl)-4-(2,6-dichlorophenyl)-1,2,3,5-oxathiadiazole-2-oxide
12) 3-(2,4-dichlorophenyl)-4-(4-chlorophenyl)-1,2,3,5-oxathiadiazole-2-oxide
13) 3-(3-chlorophenyl)-4-(2,4-chlorophenyl)-1,2,3,5-oxathiadiazole-2-oxide
14) 3-(2,4-dichlorophenyl)-4-(4-trifluorophenyl)-1,2,3,5-oxathiadiazole-2-oxide
15) 3-(2,4-dichlorophenyl)-4-(2,4-dichlorophenyl)-1,2,3,5-oxathiadiazole-2-oxide
16) 3-(2,4-dichlorophenyl)-4-(2,6-dichlorophenyl)-1,2,3,5-oxathiadiazole-2-oxide
17) 1,4-bis(2-oxo-3-phenyl-1,2,3,5-oxathiadiazolyl)-benzene
18) 1,4-bis(2-oxo-3-(3-chlorophenyl)-1,2,3,5-oxathiadiazolyl)-benzene
19) 3-phenyl-4-(4-nitrophenyl)-1,2,3,5-oxathiadiazole-2-oxide
20) 3-(3-chlorophenyl)-4-(4-nitrophenyl)-1,2,3,5-oxathiadiazole-2-oxide
21) 2,5-dihydrothiophene-1,1-dioxide
22) 3-methoxycarbonyl-2,5-dihydrothiophene-1,1-dioxide
23) 2,3-bis(1,1,3,3-tetramethylbutyl)-thiadiaziridine-1,1-dioxide The use of Compounds 1 to 16 is particularly advantageous. These compounds are outstanding in that they can be used to prepare bleachable antihalation systems with high storage stability. At the same time, they also assure a high bleaching rate with a large number of conventional antihalation dyes under current processing conditions for thermally developable photographic recording materials. Compounds 1, 4, 6, 15, and 16 are most prefered for a high bleaching rate at processing conditions between 100° and 110° C.; the bleached antihalation layers have an optical density of $\leqq 0.04$, which does not increase after prolonged storage.

The compounds essential to the invention can be purchased commercially or prepared by known methods. For example, thiadiaziridine-1,1-oxides are prepared by reacting sulfonyl chloride with primary amines and subsequent cyclization of hypochlorite. The preferred derivatives of 1,2,3,5-dipolar cycloaddition of the appropriately substituted aromatic nitrile oxides and N-sulfinyl amines. The nitrile oxides are prepared, for example, from the appropriate aldehydes going through oximes and hydroxamic acid chlorides. N-sulfinyl amines are prepared by reacting the appropriate amines with thionyl chloride.

A special advantage of the invention's bleaching agents is their wide utility with a large number of current antihalation dyes, such as, for example, oxazine, thiazine, azine, xanthene, anthraquinone, and methine dyes. The use of triphenylmethane, quinone amine, and oxonol dyes is particularly advantageous. Examples are malachite green (C.I. 42000B), C.I. acid green 3, C.I. acid green 5, C.I. acid blue 22, C.I. acid blue 93, C.I. basic violet 3, C.I. basic violet 14, the sodium salt of 4-(4-hydroxyphenyl-imino)-2,5-cyclohexadiene-1-one, 4-(4-dimethylamino-phenylimino)-2,5-cyclohexadiene-1-one, the sodium salt of 4-(4-hydroxyphenylimino)-2,6-dichloro-2,5-cyclohexadiene-1-one, oxonol blue (the dipotassium salt of 4-(5-hydroxy-3-methyl-1-(4-sulfophenyl)-4-pyrazolyl)-2,4-pentadienyl-idene)-3-methyl-1-(4-sulfophenyl)-pyrazolone), oxonol yellow (the dipotassium salt of 4-(5-hydroxy-3-methyl-1-(4-sulfophenyl)-4-pyrazolyl)-methine-3-methyl-1-(4-sulfophenyl)-pyrazolone, and acid violet (the triethyl ammonium salt of 4-(3-(4-dimethylaminophenyl)-2-propenylidene)-3-methyl-1-(4-sulfophenyl)-pyrazolone. In particular, using triphenylmethane dyes combined with the especially advantageous bleaching agents of the invention yields antihalation systems with very good storage stability and high bleaching speed at low processing temperatures.

The quantity of antihalation dye depends on the desired optical density. The dye content is usually 1–100 mmol per kg of solids in the layer, 25–95 mmol per kg being preferred for triphenylmethane dyes. The quantity of the invention's essential compounds that split off sulfurous acid or sulfurous acid derivatives depends on the dye used, the desired processing temperatures and times, and dye density reduction to be attained. The invention's compounds are generally used in approximately molar quantities or also up to 30X excess (relative to the quantity of dye), preferably in 1.5 to 20X excess, especially in 2 to 10X excess.

The invention's bleaching agents for antihalation dyes can be contained in one layer of photographic recording material or in adjacent layers. Applying the bleaching development agent is also possible just after thermal development with subsequent activation. The preferred embodiment of the invention's antihalation system is, however, a common layer for the antihalation dye and the bleaching agent between the support and the emulsion layer or, as especially preferred, on the back side of the support. In multilayer materials, antihalation layers can also be used between individual emulsion layers.

A large number of the polymeric binders conventionally employed for auxiliary layers can be used for the invention's antihalation layers. Examples of particularly suitable hydrophilic binders are polyvinyl alcohol, polyacrylic acid, polysaccharides, polystyrene sulfonic acid, and maleic acid/methyl vinyl ether copolymers, cellulose or cellulose derivatives. Mixtures of all of the binders can also be used. In particular, gelatin as a binder yields antihalation layers with high bleaching rates.

The invention's bleaching agents can be processed as solutions or dispersions. Conventional additives, such as coating aids, stabilizers, surfactants, etc., can be used. Adding water and/or compounds that bind or form hydroxide ions, such as, for example, glycerin or polyethylene oxides, can promote the bleaching reaction, especially if other than preferred binders are used. The invention's antihalation layers can be prepared by the usual coating processes with common solvents, for example, ethanol, acetone, etc. Aqueous coating solutions are preferred. The coatings are dried under conventional processing conditions. Bleaching the invention's antihalation layers is accomplished preferably by a heat treatment, for example, by placement on a hot metal platen. The materials are heated preferably at 85° to 150° C., more preferably at 90° to 125° C. Heat treatment at 100° to 110° C. is especially advantageous.

The invention's bleachable antihalation systems can be used for preparing the conventional thermally developable photographic recording materials. Their use is particularly advantageous in the so-called dry silver films. Such thermally developable silver films generally contain a light-insensitive silver salt, an organic acid, a silver halide, and a reducing agent. The silver halide can be present in very small quantities (0.1 to 20 percent by weight of the total silver salts). Examples of light-insensitive silver salts are silver behenate, silver laurate, silver palmitate, silver caprate, silver stearate, and silver saccharinate. Examples of the reducing agents used are hydroquinone, pyrocatechol, phenylenediamine, p-aminophenyl, 1-phenyl-3-pyrazolidone, or methyl gallate. Cellulose acetate, cellulose acetate butyrate, polymethyl methacrylate, polyvinyl acetate, or polyvinyl butyral are examples of binders that can be used. In addition, the dry silver films can contain the usual additives, such as, for example, sensitizers, stabilizers, toners, and surfactants. All of the usual supports, such as, for example, glass, paper, or synthetic resins sheets, such as polyamides and polyesters, are suitable. Such dry silver films, their preparation, and processing are described, for example, in Research Disclosure 17029, June 1978, pages 9–15, in Research Disclosure 29963, March 1989, pates 208–214, or in the literature cited in these two publications.

The following examples illustrate the invention. The cited parts and percents relate to weight, unless otherwise stated.

Example 1

A coating solution for making a bleachable antihalation layer was prepared from 1 g deionized gelatin, 10 g deionized water, 0.55 g 3-sulfolene, 0.8 ml of a 10% aqueous surfactant solution, 1 g of a 5% aqueous polyvinyl alcohol solution, and 0.1 ml of a 10% aqueous solution of acid violet in a 1:1 mixture of water and ethanol. The coating solution was applied with a doctor blade onto a polyester sheet (about 70 μm wet coating) and dried 24 hours at room temperature. The antihalation layer had an optical density of 0.6. The material was heated at 120° C. for 90 seconds on a hot metal plate to bleach the antihalation dye, reducing the optical density to 0.03. The decolorization was stable for 2 months.

Example 2

A bleachable antihalation layer was prepared as in Example 1, except that, instead of the dye solution of Example 1, 0.1 ml of a 10% solution of oxonol yellow in a 1:1 mixture of water and ethanol was used. The optical density of the layer was 0.5. The material was heated at 120° C. for 120 seconds on a hot metal plate to bleach the antihalation dye, reducing the optical density to 0.02. The decolorization was stable for 2 months.

Example 3 a) Preparation of 3-phenyl-4-(4-chlorophenyl)-1,2,3,5-oxathiadiazole-2-oxide

A solution of 100 mmol 4-chlorobenzaldehyde in 100 ml methanol was added dropwise within 10 minutes with vigorous stirring to a solution of 110 mmol $NH_2OHHCl$ and 50 mmol $Na_2CO_3$ in 100 ml deionized water. After the reaction mixture was stirred 2 hours at room temperature, the solid oxime was filtered off, washed with water, and air-dried overnight.

100 mmol of this oxime were dissolved in 85 ml dimethyl formamide. The solution was heated at 40° C. and 15 mmol N-chloro-succinimide were added. An additional 85 mmol N-chloro-succinimde were added portionwise, the temperature being held below 50° C. The reaction solution was poured into ice water and the reaction product was extracted 3 times by shaking with ether. The ether extracts were washed with water, dried over $CaSO_4$, and the ether was removed.

100 mmol of the resulting hydroxamic acid chloride were dissolved in a minimum of ether and cooled to −10° C. Within 2 minutes, 110 mmol triethylamine were added and the reaction was stirred 5 more minutes. The addition of a 5X excess of water precipitated the nitrile oxide, which was washed with water and air-dried overnight.

50 mmol nitrile oxide and 50 mmol N-sulfinyl aniline, prepared by reacting aniline with thionyl chloride with heat or with N-sulfinyl sulfonamide at room temperature and subsequent distillation, were dissolved in 100 ml dry ether and stirred 2 to 8 hours at room temperature, excluding ambient moisture. The end of the reaction was determined by thin-layer chromatography. The solvent was removed by vacuum and the crude product was recrystallized from ether/n-hexane or ethyl acetate/n-hexane.

b) Antihalation Layer I

A solution of 0.25 g 3-phenyl-4-(4-chlorophenyl)-1,2,3,5-oxathiadiazole-2-oxide and 0.25 g triphenyl phosphate in 1 g methyl acetate was added to a solution of 15 g of a 10% gelatin solution, 1 g of a 10% aqueous solution of sorbitan monolaurate polyglycol ether, and 0.15 g C.I. acid blue 93. This mixture was stirred 60 seconds at about 10,000 rpm. The resulting dispersion was coated with a doctor blade onto a polyester sheet (75 μm wet coating) and dried 24 hours at room temperature. The antihalation layer had an optical density of 0.55. The antihalation material also showed an adequate optical density of 0.33 even after 26 weeks of storage. The material was heated at 105° C. 30 seconds on a hot metal plate to bleach the antihalation dye, reducing the optical density to 0.03. The decolorization was stable for 26 weeks.

c) Antihalation Layer II

A solution of 0.5 g 3-phenyl-4-(4-chlorophenyl)-1,2,3,5-oxathiadiazole-2-oxide and 0.15 g triphenyl phosphate in 2 g methyl acetate was added to a solution of 7.5 g of a 10% aqueous gelatin solution, 1.5 g of a 10% aqueous surfactant solution, and 7 mg oxonol blue. This mixture was stirred 60 seconds at about 7,000 rpm. The resulting dispersion was coated with a doctor blade onto a polyester sheet (75 μm wet coating) and dried 24 hours at room temperature. The antihalation layer had an optical density of 0.45. The antihalation material showed an adequate optical density of 0.35 even after 10 weeks of storage. The material was heated at 105° C. 30 seconds on a hot metal plate to bleach the antihalation dye, reducing the optical density to 0.03. The decolorization was stable for 10 weeks.

d) Antihalation Layer III 0.5 g 3-phenyl-4-(4-chlorophenyl)-1,2,3,5-oxathiadiazole-2-oxide was dissolved in 9 g of a 5% solution of a methyl vinyl ether/maleic acid anhydride copolymer in acetone. The coating solution was applied with a doctor blade onto a polyester sheet (75 μm wet coating) and dried 24 hours at room temperature. The resulting undercoating was coated with a mixture of 15 g of a 10% aqueous gelatin solution, 0.03 g C.I. acid blue 22, and 0.1 g of a surfactant and dried at room temperature. The antihalation layer had an optical density of 0.33. The antihalation system showed an adequate optical density of 0.32 even after 26 weeks of storage. The material was heated at 105° C. 30 seconds on a hot metal plate to bleach the antihalation dye, reducing the optical density to 0.04. The decolorization was stable for 26 weeks.

Example 4

100 mmol benzaldehyde oxime were dissolved in 85 ml dimethyl formamide to prepare 3,4-diphenyl-1,2,3,5-oxathia-diazole-2-oxide. The solution was heated to 40° C. and 15 mmol N-chlorosuccinimide were added. While the temperature was held below 50° C., an additional 85 mmol N-chlorosuccinimide were added portionwise. The reaction solution was poured into ice water and the reaction product was extracted three times by shaking with ether. The extracts were washed with water, dried over $CaSO_4$, and the ether was removed. 50 mmol of the resulting hydroxamic acid chloride were dissolved in 50 ml ether. The solution was shaken with sodium hydroxide solution and the organic phase was dried. A solution of 50 mmol N-sulfinyl aniline, made by reacting aniline with thionyl chloride with heat or with N-sulfinyl sulfonamide at room temperature and subsequent distillation, in 50 ml dry ether was added and stirred 2 to 8 hours at room temperature, excluding ambient moisture. The end of the reaction was determined by thin-layer chromatography. The solvent was removed by vacuum and the crude product was recrystallized from ether/n-hexane or ethyl acetate/n-hexane.

An antihalation layer I was prepared with the resulting product and processed as described in Example 3b). The optical density of the material was 0.6 and after 26 weeks of storage was 0.32. After bleaching, the optical density was 0.03.

A second antihalation layer was prepared and processed as in Example 3c). the optical density of the material was 0.45 and after 10 weeks of storage was 0.25. After bleaching, the optical density was 0.04. The decolorization of all three layers was stable for 26 weeks.

A two-layer material was prepared and processed as in 3d. The optical density of the material was 0.35 and after 10 weeks of storage was 0.25. After bleaching the optical density was 0.04. The decolorization of all three layers was stable for 26 weeks.

Example 5

3-phenyl-4-(2,4-dichloro-phenyl)-1,2,3,5-oxathia-diazole-2-oxide was prepared from 2,4-dichlorobenzaldehyde and aniline as described in Example 3a).

An antihalation layer I was prepared with the resulting product and processed as described in Example 3b). The optical density of the material was 0.43 and after 26 weeks of storage was 0.33. After bleaching, the optical density was 0.04.

A second antihalation coating was prepared and processed as in Example 3c). The optical density of the material was 0.34 and after 10 weeks of storage was 0.3. After bleaching, the optical density was 0.03.

A two-layer material was prepared and processed as in Example 3d). The optical density of the material was 0.35 and after 10 weeks of storage was 0.3. After bleaching, the optical density was 0.05. The decolorization of all three layers was stable for 26 weeks.

Example 6

3-phenyl-4-(4-fluorophenyl)-1,2,3,5-oxathiadiazole-2-oxide was prepared from 4-fluorobenzaldehyde and aniline as described in Example 3a).

An antihalation layer I was prepared with the resulting product and processed as described in Example 3b). The optical density of the material was 0.54 and after 26 weeks of storage was 0.33. After bleaching, the optical density was 0.02. The decolorization was stable for 26 weeks.

Example 7

3-(2,4-dichlorophenyl-4-(2,4-dichlorophenyl)-1,2,3,5-oxathiadiazole-2-oxide was prepared from 2,4-dichlorobenzaldehyde and 2,4-dichloroaniline as described in Example 3a).

An antihalation layer was prepared with the resulting product and processed as described in Example 3b). The optical density of the material was 0.54 and after 26 weeks of storage was 0.34. After bleaching, the optical density was 0.02. The decolorization was stable for 26 weeks.

Example 8

3-(2,4-dichlorophenyl)-4-(2,6-dichlorophenyl)-1,2,3,5-oxathiadiazole-2-oxide was prepared from 2,6-dichlorobenzaldehyde and 2,4-dichloroaniline as described in Example 3a).

An antihalation layer was prepared with the resulting product and processed as described in Example 3b). The optical density of the material was 0.44 and after 26 weeks of storage was 0.29. After bleaching, the optical density was 0.02. The decolorization was stable for 26 weeks.

Example 9

3-(2,4-dichlorophenyl)-4-(4-trifluoromethylphenyl)-1,2,3,5-oxathiadiazole-2-oxide was prepared from 4-trifluoro-methyl benzaldehyde and 2,4-dichloroaniline as described in Example 3a).

An antihalation layer was prepared with the resulting product and processed as described in Example 3b). The optical density of the material was 0.41 and after 26 weeks of storage was 0.27. After bleaching, the optical density was 0.02. The decolorization was stable for 26 weeks.

Example 10

3-phenyl-4-(4-nitrophenyl)-1,2,3,5-oxathiadiazole-2-oxide was prepared from 4-nitrobenzaldehyde and aniline as described in Example 3a).

An antihalation layer with acid blue 22 as the antihalation dye was prepared from the resulting product and processed as described in Example 3b). The optical density of the material was 0.32 and after 26 weeks of storage was 0.26. After bleaching, the optical density was 0.04 (130° C., 90 seconds). The decolorization was stable for 26 weeks.

Example 11

1,4-bis(2-oxo-3-(3-chlorophenyl)-1,2,3,5-oxathiadiazolyl)-benzene was prepared from terephthalic dialdehyde and 3-chloroaniline as described in Example 3a); in the final reaction step, 100 mmol N-sulfinyl-3-chloroaniline were added.

An antihalation layer was prepared with the resulting product and processed as described in Example 3c). The optical density of the material was 0.3 and after 10 weeks of storage was 0.3. After bleaching, the optical density was 0.04 (130° C., 90 seconds). The decolorization was stable for 10 weeks.

What is claimed is:

1. A bleachable antihalation system containing (a) a bleaching agent which is 2,4-diaryl-substituted 1,2,3,5-oxathiadiazole-2-oxide, wherein said aryl groups are unsubstituted or independently of each other substituted by at lest one substituent selected from the set consisting of alkyl, aryl, ether, ester, halogen, hydroxy, cyano, amino, carbonyl, carxboxyl, carbamoyl, sulfonyl groups, carbocyclic and heterocyclic annular ring, and (b) an antihalation dye which is triphenylmethane, quinone imine or oxonol dye with the proviso that said system upon exposure to heat, actinic radiation, or combination thereof, said bleaching agent forms at least one of sulfurous acid, derivitized sulfuric acid or sulfur dioxide.

2. A bleachable antihalation system as recited in claim 1 wherein said bleaching agent form sulfur dioxide upon treatment with heat, actinic a radiation or combinations thereof, said bleaching agent further comprises water, hydroxide ions or combinations thereof or is capable of forming water, hydroxide ions or combinations thereof upon treatment with heat, actinic radiation or combinations thereof.

3. A bleachable antihalation system as recited in claim 1 characterized in that it further comprises gelatin or gelatin derivatives as a binder.

4. A bleachable antihalation system as recited in claim 1 wherein said bleaching agent is chosen from the set consisting of:

3,4-diphenyl-1,2,3,5-oxathiadiazole-2-oxide;
3-phenyl-4-(2-chlorophenyl)-1,2,3,5-oxathiadiazole-2-oxide;
3-phenyl-4-(4-chlorophenyl)-1,2,3,5-oxathiadiazole-2-oxide;
3-phenyl-4-(4-fluorophenyl)-1,2,3,5-oxathiadiazole-2-oxide;
3-phenyl-4-(2,6-dichlorophenyl)-1,2,3,5-oxathiadiazole-2-oxide;
3-phenyl-4-(2,4-dichlorophenyl)-1,2,3,5-oxathiadiazole-2-oxide;
3-phenyl-4-(4-bromophenyl)-1,2,3,5-oxathiadiazole-2-oxide;
3-(3-chlorophenyl)-4-(2-chlorophenyl)-1,2,3,5-oxathiadiazole-2-oxide;
3-(2,4-dichlorophenyl)-4-(4-fluorophenyl)-1,2,3,5-oxathiadiazole-2-oxide; 3-(3-chlorophenyl)-4-(4-trifluoromethylphenyl)-1,2,3,5-oxathiadiazole-2-oxide;
3-(3-chlorophenyl)-4-(2,6-dichlorophenyl)-1,2,3,5-oxathiadiazole-2-oxide; 3-(2,4-dichlorophenyl)-4-(4-chlorophenyl)-1,2,3,5-oxathiadiazole-2-oxide; 3-(3-chlorophenyl)-4-(2,4-chlorophenyl)-1,2,3,5-oxathiadiazole-2-oxide; 3-(2,4-dichlorophenyl)-4-(4-trifluorophenyl)-1,2,3,5-oxathiadiazole-2-oxide; 3-(2,4-dichlorophenyl)-4-(2,4-dichlorophenyl)-1,2,3,5-oxathiadiazole-2-oxide; 3-(2,4-dichlorophenyl)-4-(2,6-dichlorophenyl)-1,2,3,5-oxathiadiazole-2-oxide; 1,4-bis(2-oxo-3-phenyl-1,2,3,5-oxathiadiazolyl)-benzene; 1,4-bis(2-oxo-3-(3-chlorophenyl)-1,2,3,5-oxathiadiazolyl)-benzene; 3-phenyl-4-(4-nitrophenyl)-1,2,3,5-oxathiadiazole-2-oxide; 3-(3-chlorophenyl)-4-(4-nitrophenyl)-1,2,3,5-oxathiadiazole-2-oxide; 2,5-dihydrothiophene-1,1-dioxide; 3-methoxycarbonyl-2,5-dihydrothiophene-1,1-dioxide; 2,3-bis(1,1,3,3-tetramethylbutyl)-thiadiaziridine-1,1-dioxide.

5. A bleachable antihalation system as recited in claim 4 wherein said bleaching agent is chosen from the set consisting of:

3,4-diphenyl-1,2,3,5-oxathiadiazole-2-oxide;
3-phenyl-4-(2-chlorophenyl)-1,2,3,5-oxathiadiazole-2-oxide;
3-phenyl-4-(4-chlorophenyl)-1,2,3,5-oxathiadiazole-2-oxide;
3-phenyl-4-(4-fluorophenyl)-1,2,3,5-oxathiadiazole-2-oxide;
3-phenyl-4-(2,6-dichlorophenyl)-1,2,3,5-oxathiadiazole-2-oxide;
3-phenyl-4-(2,4-dichlorophenyl)-1,2,3,5-oxathiadiazole-2-oxide;
3-phenyl-4-(4-bromophenyl)-1,2,3,5-oxathiadiazole-2-oxide;
3-(3-chlorophenyl)-4-(2-chlorophenyl)-1,2,3,5-oxathiadiazole-2-oxide;
3-(2,4-dichlorophenyl)-4-(4-fluorophenyl)-1,2,3,5-oxathiadiazole-2-oxide; 3-(3-chlorophenyl)-4-(4-trifluoromethylphenyl)-1,2,3,5-oxathiadiazole-2-oxide; 3-(3-chlorophenyl)-4-(2,6-dichlorophenyl)-1,2,3,5-oxathiadiazole-2-oxide; 3-(2,4-dichlorophenyl)-4-(4-chlorophenyl)-1,2,3,5-oxathiadiazole-2-oxide; 3-(3-chlorophenyl)-4-(2,4-chlorophenyl)-1,2,3,5-oxathiadiazole-2-oxide; 3-(2,4-dichlorophenyl)-4-(4-trifluorophenyl)-1,2,3,5-oxathiadiazole-2-oxide; 3-(2,4-dichlorophenyl)-4-(2,4-dichlorophenyl)-1,2,3,5-oxathiadiazole-2-oxide; 3-(2,4-dichlorophenyl)-4-(2,6-dichlorophenyl)-1,2,3,5-oxathiadiazole-2-oxide.

6. A bleachable antihalation system as recited in claim 5 wherein said bleaching agent is chosen from the set consisting of:

3,4-diphenyl-1,2,3,5-oxathiadiazole-2-oxide; 3-phenyl-4-(4-fluorophenyl)-1,2,3,5-oxathiadiazole -2-oxide; 3-phenyl-4-(2,4-dichlorophenyl)-1,2,3,5-oxathiadiazole-2-oxide; 3-(2,4-dichlorophenyl)-4-(2,6-dichlorophenyl)-1,2,3,5-oxathiadiazole-2-oxide.

7. A bleachable antihalation system as recited in claim 1 wherein said treatment comprises heating said bleachable antihalation system at 85°–150° C.

8. A bleachable antihalation system as recited in claim 1 further characterized with an optical density of no more than 0.04 after said treatment.

9. A bleachable antihalation system as recited in claim 1 wherein the weight of said bleaching agent in said system is no more than 30 times the weight of said antihalation dye.

10. A bleachable antihalation system as recited in claim 9 wherein the weight of said bleaching agent in said system is 1.5 to 20 times the weight of said antihalation dye.

11. A bleachable antihalation system as recited in claim 10 wherein the weight of said bleaching agent in said system is 2 to 10 times the weight of said antihalation dye.

* * * * *